US005084809A

United States Patent [19]

Bogdanovs

[11] Patent Number: 5,084,809

[45] Date of Patent: Jan. 28, 1992

[54] UNIVERSAL ADJUSTABLE COVER

[75] Inventor: Andris Bogdanovs, Liverpool, N.Y.

[73] Assignees: Incubation Industries Inc., Ivyland, Pa.; Cooper Industries, Inc., Houston, Tex.

[21] Appl. No.: 524,517

[22] Filed: May 17, 1990

[51] Int. Cl.[5] ..... F21S 1/02

[52] U.S. Cl. ..... 362/370; 362/375; 362/376; 362/388; 362/431; 285/907

[58] Field of Search ..... 362/368, 370, 375, 382, 362/388, 363, 431, 362, 145, 404, 457, 376, 147, 408; 248/318; 439/535; D26/72; 285/907

[56] References Cited

U.S. PATENT DOCUMENTS 1,043,797 11/1912 Bissell et al. ..... 362/376
1,762,995 6/1930 Knight ..... 362/457 X
2,840,691 6/1958 Bobrick et al. ..... 439/535 X
3,222,509 12/1965 Thedford ..... 362/431 X
3,335,270 8/1967 Rongey et al. ..... 362/376 X
4,300,190 11/1981 Mershon ..... 362/147 X
4,363,086 12/1982 Fletcher ..... 362/368

*Primary Examiner*—Stephen F. Husar
*Attorney, Agent, or Firm*—William H. Murray; Frank M. Linguiti; Nelson A. Blish

[57] ABSTRACT

A universal adjustable cover 20 for a lighting fixture 10. Universal cover 20 has openings for mounting on a conduit 50 parallel to the ceiling, and additional openings 22 for angle mounting and 24 for mounting on a vertical conduit. Universal adjustable cover eliminates need for stocking a large number of lighting fixtures for only one mounting configuration.

15 Claims, 3 Drawing Sheets

UNIVERSAL ADJUSTABLE COVER

BACKGROUND OF THE INVENTION

This invention relates in general to lighting fixtures and more particularly to a high intensity discharge type lamp used in hazardous or non-hazardous areas having a universal adjustable cover.

In the past in order to install lighting fixtures for different applications, it was necessary to purchase a different lighting fixture for each application. For an electrical conduit mounted parallel to the ceiling a lighting fixture with a cover having a through feed conduit was necessary. In order to install a pendant lighting fixture, that is one which is hung from a conduit perpendicular to the ceiling, it was necessary to purchase a lighting fixture having a different cover. Thus, it was often necessary to stock numerous different lighting fixtures configured for specific mounting requirements.

SUMMARY OF THE INVENTION

The present invention provides a universal adjustable cover that is capable of being mounted in a number of different configuration, such as a through feed conduit mounting, trunion mount, pendant mounting, or angular mounting. This reduces the number of specific mounting configurations required to be stocked.

DETAILED DESCRIPTION OF THE PRESENT INVENTION

Figure 1:
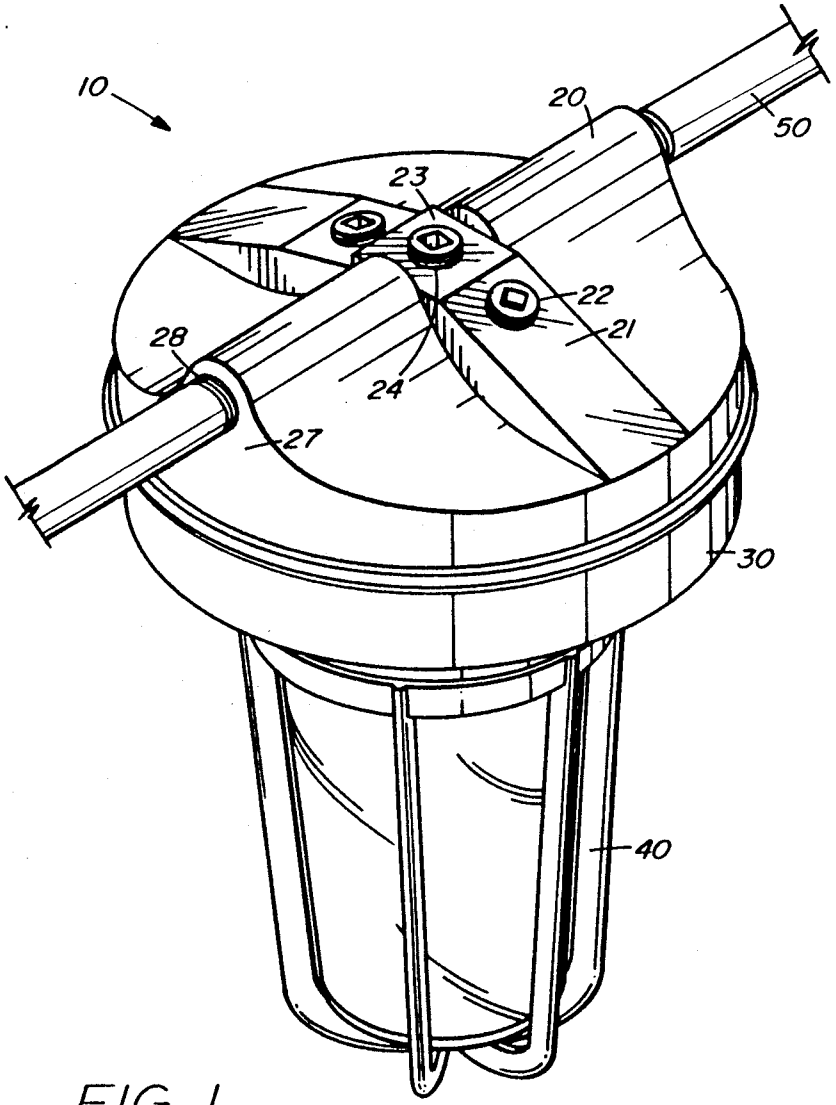
FIG. 1 shows a lighting fixture according to the present invention having a through feed conduit mounting.

Referring now to the drawings and in particular FIG. 1, the light fixture 10 is comprised in general of universal adjustable cover 20, housing 30, and optics 40. Conduit 50 provides electrical wiring entrance to lighting fixture 10.

Figure 2:
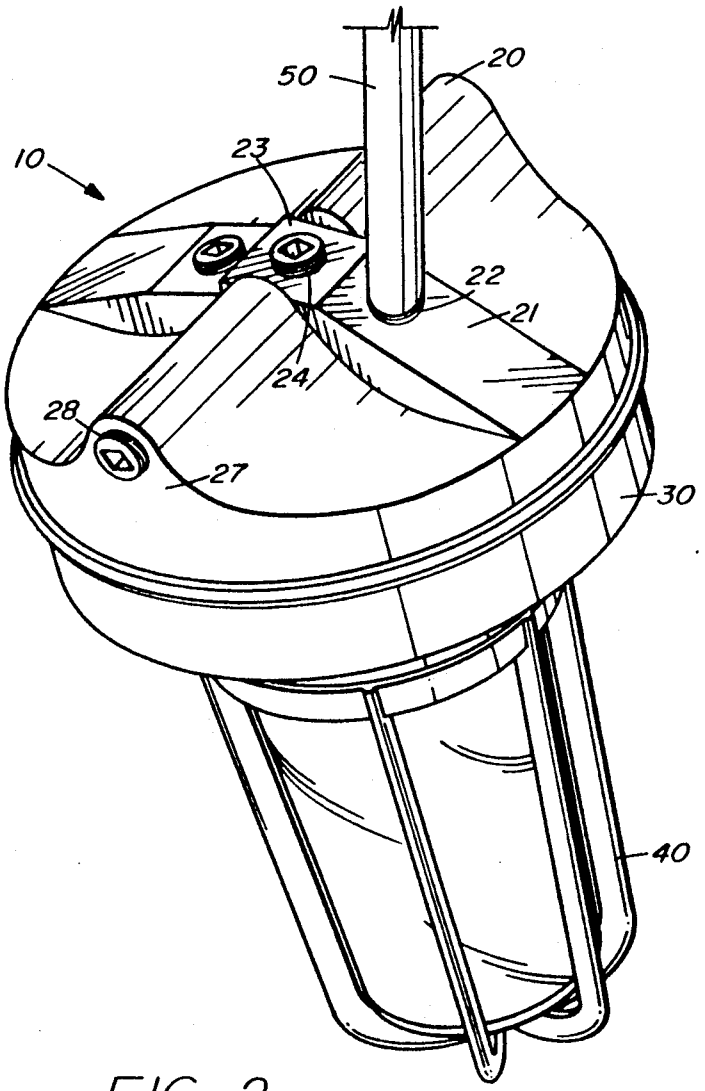
FIG. 2 shows a lighting fixture universal cover according to the present invention, having a 25 degree pendant mount.

Adjustable cover 20 has a 25 degree flat area 21 and conduit opening 22 mounted in said 25 degree flat. The separate conduit opening 22 provides for mounting lighting fixture 10 in a different configuration as shown in FIG. 2. When mounted in configuration shown in FIG. 2 the light is directed at a 25 degree angle from the vertical. It is understood that the angle of flat 21 could be anything from the perpendicular up to approximately 90 degrees.

Figure 4:
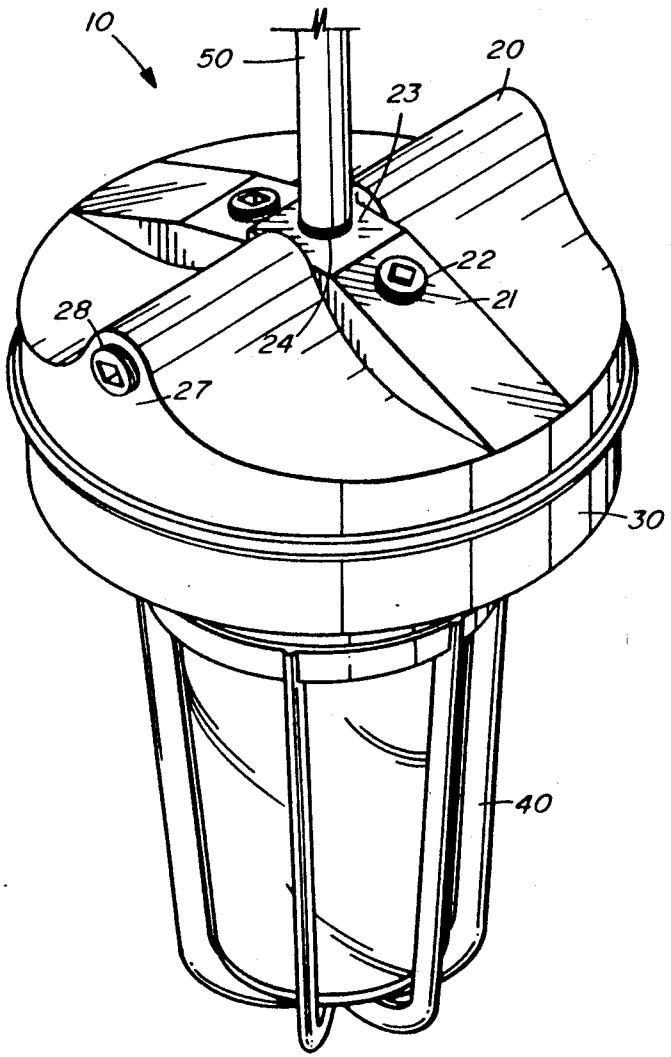
FIG. 4 shows a lighting fixture according to the present invention pendant mounted with the conduit mounted in the perpendicular flat.
Figure 3:
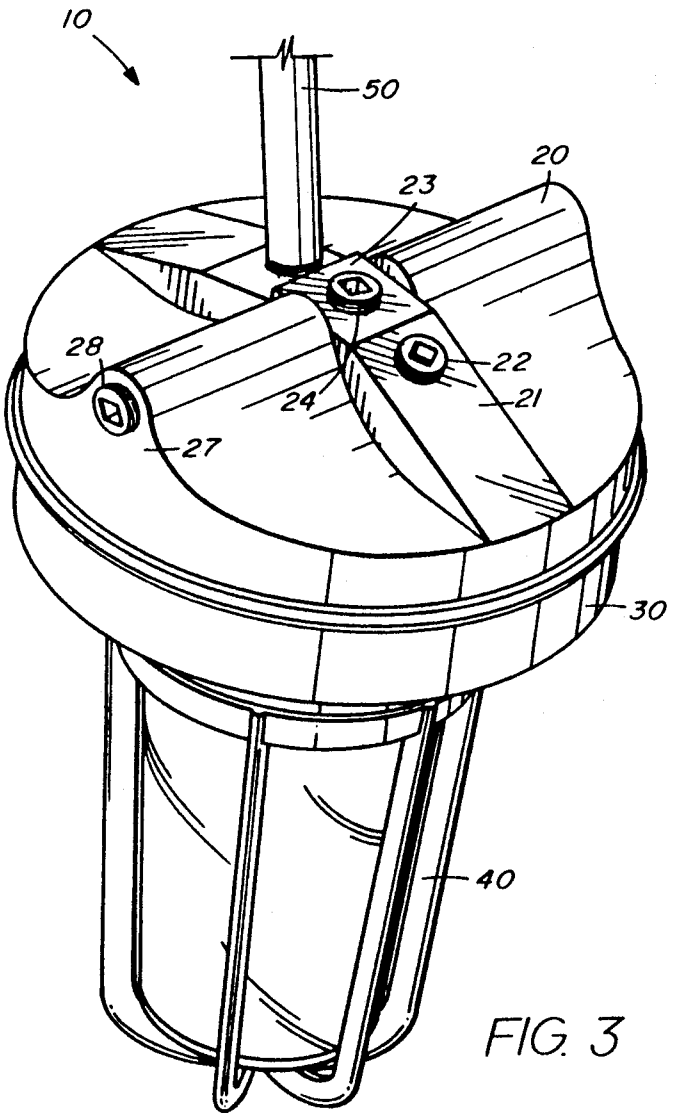
FIG. 3 shows a lighting fixture according to the present invention pendant mounted on a 12.5 degree flat.

Lighting fixture 10 may also be mounted on a vertical conduit such as shown in FIG. 4. In this configuration conduit 50 is attached through opening 24.

Figure 5:
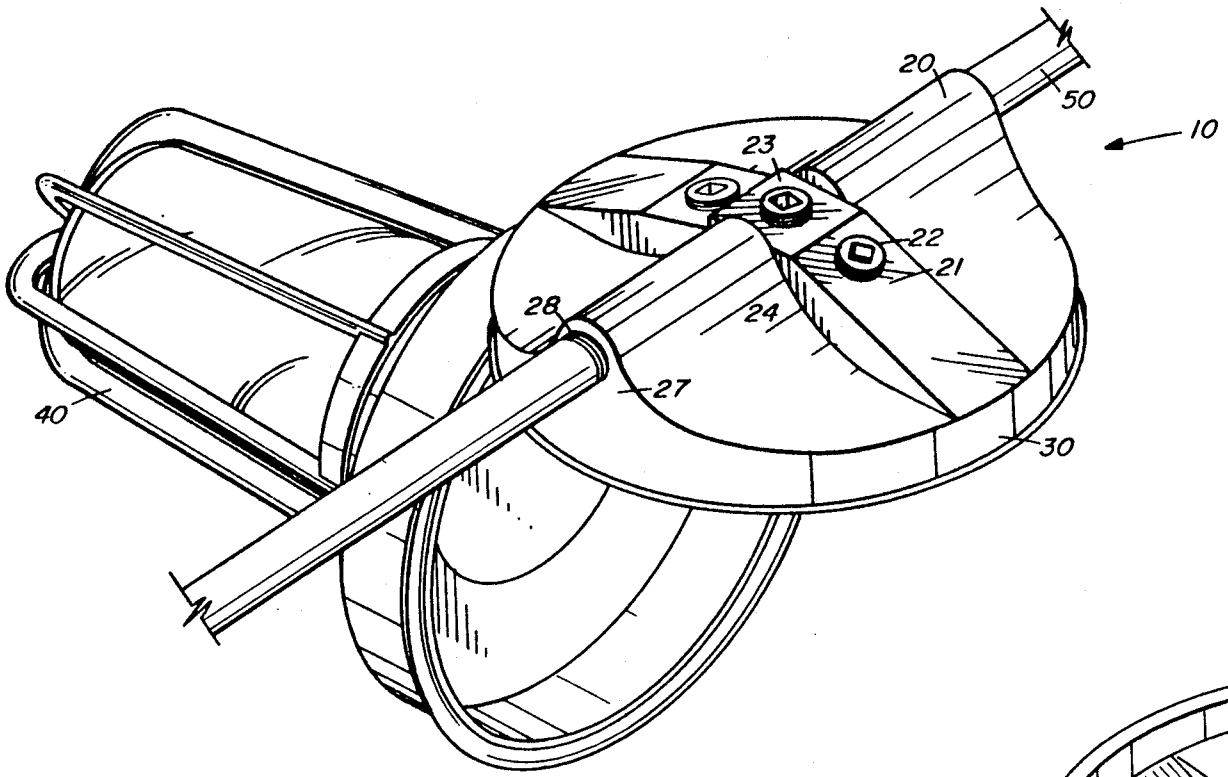
FIG. 5 shows the lighting fixture of FIG. 1 opened at a hinge.

FIG. 5 shows lighting fixture 10 with housing 30 in the open position. Housing 30 is attached to cover 20 by a hinge, not shown, so that housing 30 is held in place and both hands are free so that wiring from conduit 50 may be attached to internal components contained in housing 30.

Figure 6:
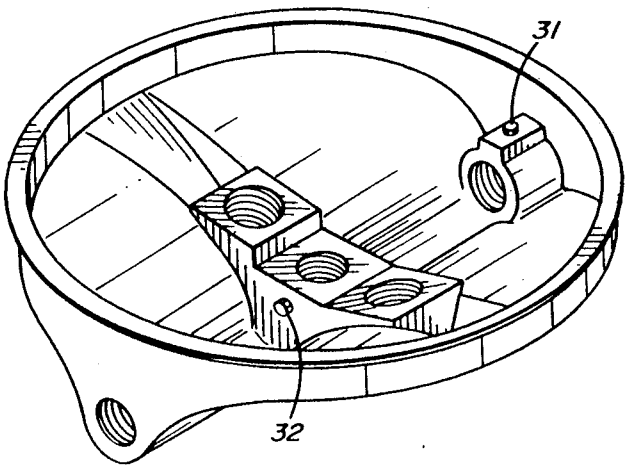
FIG. 6 shows the interior of the cover of the lighting fixture of FIG. 1.

FIG. 6 shows the interior of cover 20. Set screws 31 are mounted in through feed conduit opening 28. During installation, cover 20 may be rotated around an axis parallel to conduit 50 for directing the light from optics 40 in a different direction. After the mounting direction is established, set screws 31 are tightened to prevent inadvertent rotation after installation. In a through feed mode rotation is normally limited to approximately 25 degrees by flat area 21. This is due to normal conduit mounting approximately ¾" below ceiling level. However it should be noted that it is possible when conduit 50 is mounted well below ceiling level, lighting fixture 10 can be mounted at any angle through 360 degree rotation about conduit 50 and locked in place by set screw 31.

FIG. 6 shows set screws 32 in cover 20 which are used during installation in pendant mode as shown in FIG. 2. 3 and 4. In these configuration, cover 20 of lighting fixture 10 may be rotated during installation through 360 degrees about an axis parallel to conduit 50. Once the cover 20 is installed, set screws 32 are used to lock the cover and the lighting fixture in place so that the lighting fixture 10 may not be rotated after installation which would damage internal wiring and components.

A similar set screw 32 is provided on opening 22 when lighting fixture 10 is mounted at an angle as shown in FIG. 2. Lighting fixture 10 may be rotated about an angle through 360 degrees about an axis parallel to conduit 50 to direct the light to certain areas. Once the set screw is set, the light may not be rotated after installation, thereby protecting internal wiring and components.

Universal adjustable cover in the preferred embodiment is made of a conductible alloy, for example aluminum which may be produced by any number known processes, for example sand casting, die casting, stamping, or forging. Using conductive material for cover 20 allows the cover to be grounded to the conduit system. Cover 20 however could be produced from any material including insulating material. If made of insulating material cover 20 would normally have metal inserts at the conduit openings to provide grounding to the conduit system and internal components.

What is claimed is:

1. A lighting fixture having a universal adjustable cover wherein said universal adjustable cover having mounting means thereon, said mounting means including at least one through feed conduit opening, a pendant conduit opening, and an angled conduit opening, said openings disposed on said cover to provide a mounting for selected physical attachment of one end of a conduit thereto to support said cover and provide an electrical conduit path thereto, said conduit extending into only one of said openings, said conduit having a second end attached to a mounting surface, to support said fixture with respect to said mounting surface, said conduit including wiring path means for introducing wire into the fixture.

2. The lighting fixture as in claim 1, wherein said angle conduit opening is an aperture in said adjustable cover and is angularly disposed from said pendant opening by 25 degrees.

3. A lighting fixture as in claim 1 wherein said angle conduit opening is an aperture in said adjustable cover and is angularly disposed from said pendant opening by 12.5 degrees.

4. A lighting fixture as in claim 1 wherein said cover has an opening angularly disposed from said pendant opening by 25 degrees and an opening angularly disposed from said pendant opening by 12.5 degrees.

5. A lighting fixture as in claim 1 wherein said lighting fixture can be rotatably adjusted about an axis parallel to said through feed conduit opening.

6. A lighting fixture as in claim 5 wherein flats on said cover limit the amount of rotatably adjusted about an axis parallel to said through feed conduit opening.

7. A lighting fixture as in claim 1 wherein said lighting fixture can be rotatably adjusted 360 degrees around said pendant opening.

8. A lighting fixture as in claim 1 wherein said lighting fixture can be rotatably adjusted 360 degrees around said angle conduit opening.

9. A lighting fixture as in claim 1 wherein said through feed conduit opening has a set screw to lock said cover in place after installation.

10. A lighting fixture as in claim 1 wherein the fixture includes a housing attached to said cover, and said cover has a hinge so that said housing maybe swung down in order to attach electrical wiring to components in said housing.

11. A lighting fixture as in claim 1 wherein said cover has a second through feed opening.

12. A lighting fixture spatially supported, with reference to a structural surface, by a conduit, comprising;

a cover;

a housing attached to said cover;

said cover having multiple conduit attachment means for attaching said cover to the conduit, each of said attachment means disposed on said cover in relation to said housing to locate said housing in a different position with respect to said structural surface dependant upon the selected mounting of the conduit to one of said mounting attachment means;

wherein said multiple attachment means include threaded apertures disposed in a first pendant mounting flat, an angled flat disposed at an angle of 25 degrees to said pendant flat, and a through mount boss disposed at a 90 degree angle to said pendant mounting flat.

13. The lighting fixture of claim 12, wherein said housing is structured to direct lighting therefrom, and said multiple attachment means includes a pendant mount aperture therein disposed to receive the conduit and direct said light vertically with respect to said structural surface.

14. The lighting fixture of claim 12, wherein said housing is structured to direct lighting therefrom, and said multiple attachment means includes at least one through aperture therein disposed to receive the conduit and direct said light normal to the conduit received within said through aperture.

15. The lighting fixture of claim 12, wherein housing is structured to direct lighting therefrom, and said multiple attachment means includes an angled aperture therein disposed to receive the conduit and direct said light at an angle with respect to said structural surface.

* * * * *

UNITED STATES PATENT AND TRADEMARK OFFICE

CERTIFICATE OF CORRECTION

PATENT NO. : 5,084,809

DATED : January 28, 1992

INVENTOR(S) : Andris Bogdanovs

It is certified that error appears in the above—identified patent and that said Letters Patent is hereby corrected as shown below:

Title Page:

(73) Assignee: --- delete --- "Incubation Industries, Inc., Ivyland, Pa;"

Signed and Sealed this

Twentieth Day of July, 1993

*Attest:*

Michael K. Kirk

MICHAEL K. KIRK

*Attesting Officer*

*Acting Commissioner of Patents and Trademarks*